United States Patent [19]

Tischer et al.

[11] Patent Number: 4,896,080

[45] Date of Patent: Jan. 23, 1990

[54] FLAT PICTURE-REPRODUCING DEVICE

[75] Inventors: Kurt M. Tischer, Wendlingen; Uwe Mayer, Kirchheim/Teck, both of Fed. Rep. of Germany

[73] Assignee: Nokia Unterhaltungselektronik, Pforzheim, Fed. Rep. of Germany

[21] Appl. No.: 291,316

[22] Filed: Dec. 28, 1988

Related U.S. Application Data

[63] Continuation of Ser. No. 64,229, Jun. 18, 1987, abandoned.

[30] Foreign Application Priority Data

Jul. 2, 1986 [DE] Fed. Rep. of Germany ..... 3622259

[51] Int. Cl.[4] ..... H01J 29/70

[52] U.S. Cl. ..... 315/366; 315/169.1; 313/422

[58] Field of Search ..... 315/169.1, 364, 366; 313/302, 422, 409, 495; 358/56, 230

[56] References Cited

U.S. PATENT DOCUMENTS

| | | | |
|---|---|---|---|
| 4,227,117 | 10/1980 | Watanabe et al. | 313/422 |
| 4,535,272 | 8/1985 | Ueda et al. | 313/422 |
| 4,736,139 | 4/1988 | Tomii et al. | 315/366 |

FOREIGN PATENT DOCUMENTS

| | | |
|---|---|---|
| 3529041 | 2/1987 | Fed. Rep. of Germany . |
| 60-185343 | 9/1985 | Japan . |

*Primary Examiner*—Robert L. Griffin
*Assistant Examiner*—T. Salindong
*Attorney, Agent, or Firm*—Peter C. Van Der Sluys

[57] ABSTRACT

In a flat, vacuum-enclosed picture-reproducing device having a phosphor-coated glass faceplate and a shallow tray-shaped rear housing in which a cathode consisting of a periodic array of oxide-coated heating wires is located in front of a counterelectrode, and which contains a control arrangement between the cathode and the faceplate, a perforated anode is present between the heating wires and the control arrangement, which consists of two layers of electrodes, and the counterelectrode has segments arranged perpendicular to the longitudinal dimension of the oxide-coated heating wires.

15 Claims, 4 Drawing Sheets

FLAT PICTURE-REPRODUCING DEVICE

This is a continuation of co-pending application Ser. No. 064,229 filed on 06/18/87 now abandoned.

BACKGROUND OF THE INVENTION

1. Field of the Invention

The present invention relates to a flat picture-reproducing device and to a method of operating such a device.

2. Description of the Prior Art

A flat picture-reproducing device is known from an article entitled "Der flache Fernsehbildschirm" published in Vol. 10 (1980) of the Funkscha" periodical, pp. 63 to 66, FIG. 2. FIG. 2 of said article is further explained in a digest of a technical paper by W. Scott, et al, entitled: "Flat Cathode-Ray-Tube Display", SID International Symposium, Digest of Technical Papers, 1978, S.88 and 89. It has a glass faceplate which is at a high positive potential and whose inside is coated with phosphors, a digitally addressed multilayer control arrangement for shaping and modulating the stream of electrons, an area cathode which emits a uniform stream of electrons in the direction of the control arrangement, and a metal-shell vacuum enclosure at the rear. The cathode is formed by a periodic array of oxide-coated heating wires in whose vicinity a field-shaping counterelectrode is located. In a plane between this counterelectrode and the heating wires, a periodic array of elongate field-shaping electrodes arranged parallel to the heating filaments is provided.

This area cathode requires a large amount of heating power because the cathode must provide the maximum current density for the peak brightness at any moment, although only a fraction of the current density is needed most of the time. This static operating mode is detrimental to the oxide-coated heating wires and shortens their useful life. At the same time, the current requirement is increased due to the complicated control arrangement, which is only slightly transparent to electrons.

SUMMARY OF THE INVENTION

It is an object of the present invention to provide an area cathode for a flat picture-reproducing device which cathode requires less power, produces a uniform, high brightness of the phosphor coating and allows the use of a simple control arrangement.

It is a further object of the invention to provide a method for operating such a picture-reproducing device.

The first object mentioned above is achieved by an area cathode disposed in a flat, vacuum-enclosed picture-reproducing device having a phosphor-coated glass faceplate and a shallow tray-shaped rear housing. The cathode comprises a periodic array of oxide-coated heating wires located in front of a counterelectrode. A separate control arrangement including two layers of electrodes is provided between the cathode and the faceplate. A perforated anode is present between the heating wires and the control arrangement. The counterelectrode has segments arranged perpendicular to the longitudinal dimension of the oxide-coated heating wires. The heating wires of the cathode are arranged parallel to the lines to be displayed on the faceplate. The distance between the anode and the heating wires is one to ten times the distance between the counterelectrode and the heating wires.

The second object mentioned above is achieved by a method wherein a positive voltage of 10 to 20 V is applied to the anode and different negative and positive voltages averaging about 5 V are applied to the segments of the counterelectrode. As the line to be displayed shifts, a stream of electrons is withdrawn only from the associated heating wires which are at a positive potential with respect to the counterelectrode while being heated, and at zero potential during the withdrawal of the stream of electrons. The stream of electrons is perferrably withdrawn from pairs of neighboring heating wires.

One end of each heating wire is connected via a switch to a positive terminal of a heating-voltage source and the other end of each heating wire is connected via a changeover switch to a negative terminal of the heating-voltage source or to ground. The negative terminal of the heating-voltage source is connected to the positive terminal of a voltage source having its other terminal grounded.

Depending on the brightness of the respective picture element in the line being displayed, a voltage of −15 to 5 V is applied to the segments of the counterelectrode. To correct the brightness differences between the individual lines, the segments of the counterelectrode are subjected to additional correcting voltages in the range of −5 to 10 V. The correcting voltages are selected from a storage means and applied together with the video signals. This correction is effected line by line and picture element by picture element.

DETAILED DESCRIPTION OF THE INVENTION

Figure 1:
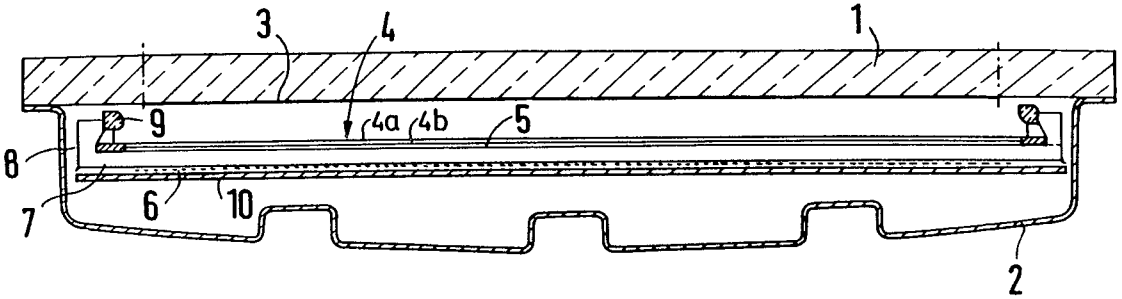
FIG. 1 is a vertical section of a flat picture-reproducing device of the present invention.

FIG. 1 is a section of the flat picture-reproducing device. A glass faceplate 1 and a tray-shaped rear housing 2 form an enclosure which is evacuated. The inside of the faceplate has a phosphor coating 3; the individual picture elements are not shown. Located at a distance from the faceplate 1 is a control arrangement 4 which consists of two layers **4*a* and 4*b* of electrodes. It is followed by a perforated anode 5 which draws the electrons emitted by an area cathode towards the phosphor coating 3. A segmented counterelectrode 6 is deposited on the inside of an insulating support 10**. The counterelectrode is preceded by the area cathode, which is constituted by a periodic array of oxide-coated heating wires 7. The heating wires 7 are held by springs 8 which are attached to an insulating mounting member 9. The heating wires 7 all lie in a plane parallel to the plane of the counterelectrode 6, and they extend parallel to the lines to be displayed on the faceplate. The segments of the counterelectrode 6 run perpendicular to the longitudinal dimension of the heating wires 7. The distance between the heating wires 7 and the anode 5 is about one to ten times the distance between the heating wires 7 and the counterelectrode 6.

Figure 2:
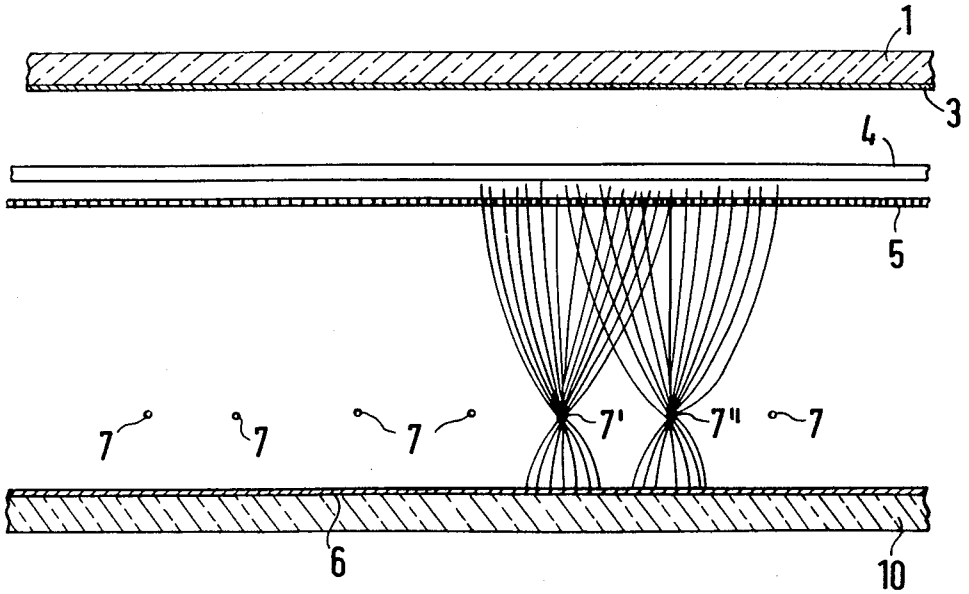
FIG. 2 is a partial section of the picture-reproducing device of FIG. 1.

FIG. 2 shows only a part of the picture-reproducing device in a sectional view. In this representation, the heating wires 7 run perpendicular to the plane of the paper; electron paths are shown for the two heating wires 7'and 7''.

Figure 2A:
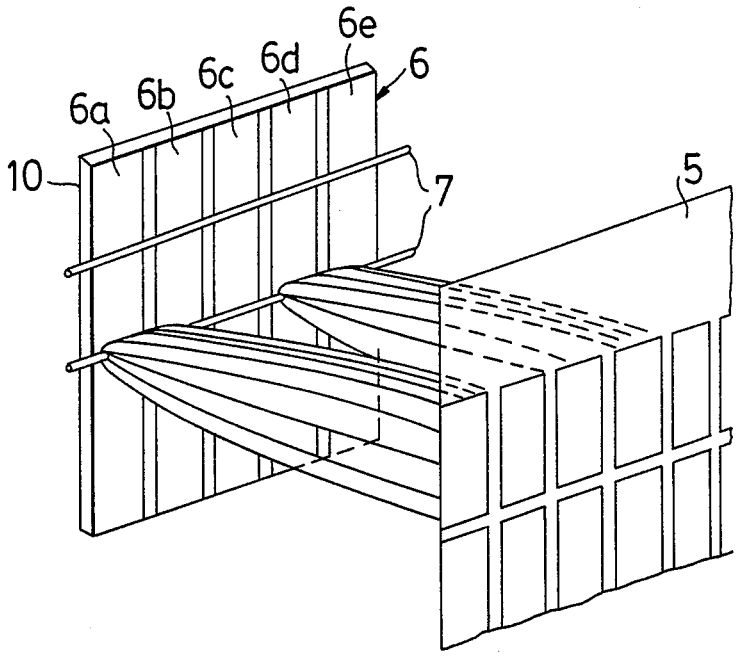
FIG. 2A is a partial perspective view showing a portion of the picture-reproducing device of FIG. 1.

FIG. 2A shows only a part of the picture-reproducing device in a perspective view. In this representation, the heating wires 7 are clearly shown running perpendicular to segments 6*a* through 6*e* of the counterelectrode 6. The perforated anode 5 is shown in greater detail to illustrate the flow of electrons from wire 7 to the anode for forming the picture elements.

With the structure shown in FIGS. 1, 2 and 2A, the operation of an area cathode for a flat picture-reproducing device can be described. It will be assumed that the segmented counterelectrode 6 is at a potential of about 5 V and the anode 5 is at a potential of 10 to 20 V. The heating wires 7 are at a positive potential which prevents electron flow to the anode. An additionally applied heating voltage causes current to flow through the heating wires 7 which heats them to a temperature of about 650° C.. At that temperature, the oxide on the heating wires emits electrons. If the heating wires are then disconnected from the heating voltage and connected to a potential of 0 V, the positive potentials are effective at the counterelectrode 6 and at the anode 5 and move the emitted electrons along the paths shown schematically in FIGS. 2 and 2A for the heating wires 7' and 7''. Part of the electrons flow off through the counterelectrode, but this has no harmful effect. A majority of the electrons pass through the holes in the anode 5 and through the control arrangement 4 and travel to the phosphor coating 3, which is at a high positive potential. Behind the control arrangement 4 in FIG. 2, electrons are present only in the area which was not blocked by the control arrangement and which corresponds to one line to be displayed.

Since the picture to be displayed is reproduced line by line, it is sufficient to connect pairs of neighboring heating wires 7 associated with the respective line to the potential of 0 V, as is shown in FIG. 2. The electron paths then overlay in the central area between the two heating wires, and from this area, the control arrangement 4 selects the electrons for one line at a time. Since this area is relatively wide, electrons can be withdrawn for several lines in succession. Accordingly, considerably fewer heating wires 7 than lines to be displayed must be present.

Figure 3:
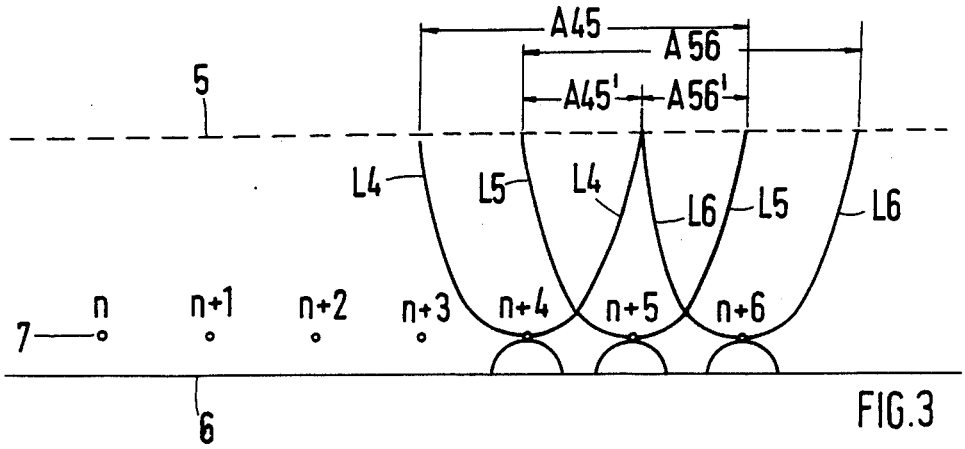
FIG. 3 is a schematic representation of part of an area cathode used in the device of FIG. 1.
Figure 4:
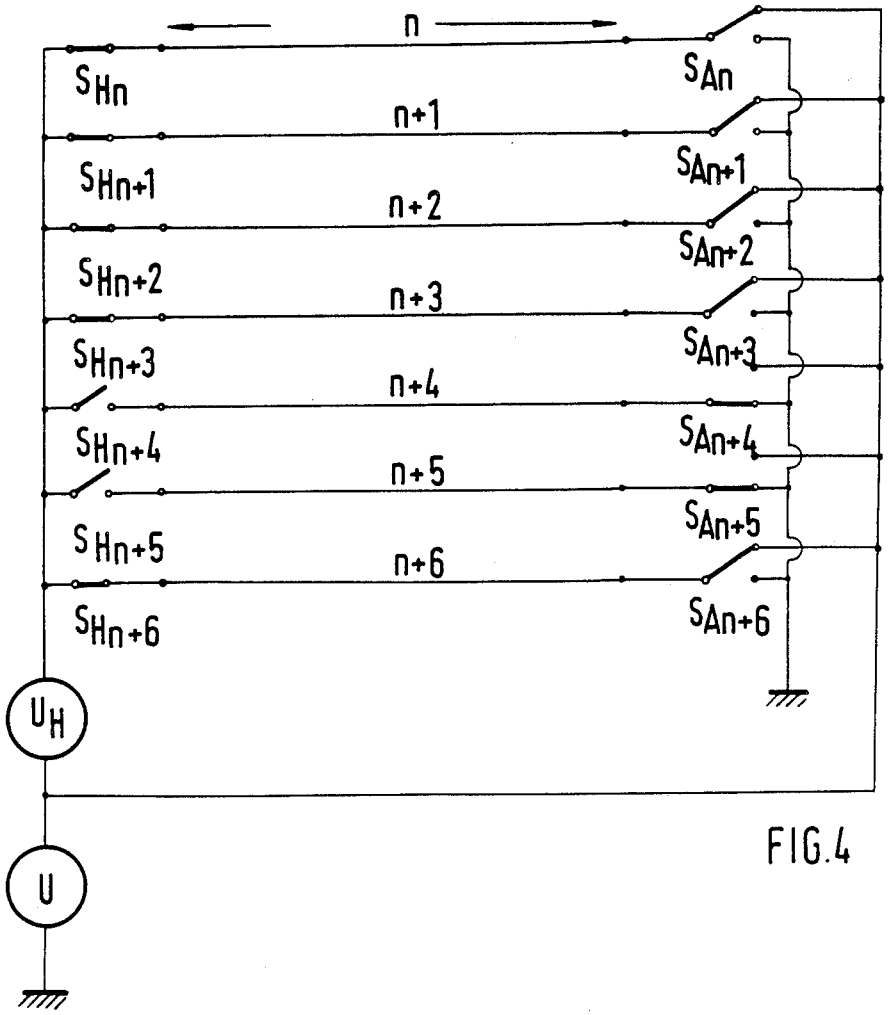
FIG. 4 shows a circuit arrangement for operating the area cathode of FIG. 3.

FIG. 3 shows part of the area cathode, the anode 5, and the counterelectrode 6 in a schematic section perpendicular to the heating wires 7. There are seven heating wires 7 which are designated n to n+6. The anode 5 is at a potential of 10 to 20 V, and the counterelectrode 6 is at a potential of 5 V. The heating wires 7 designated n to n+3 and n+6 are connected to a heating-voltage source $U_H$, as shown in FIG. 4 so that a current flows through them and heats them. At the potentials mentioned above, the emitted electrons are attracted neither to the anode 5 nor to the counterelectrode 6 because these heating wires are additionally at a positive potential provided by a voltage source U as shown in FIG. 4. The heating wires 7 designated n+4 and n+5 are not energized and are at a potential of 0 V. Thus, electrons whose paths are within the areas bounded by the lines L4 and L5 are attracted from the wires n+4 and n+5, respectively, to the anode 5 and the counterelectrode 6. It can be seen that the anode 5 receives electrons in an area A45 which has an increased electron density in its central portion A45'. From this portion A45', electrons are withdrawn line by line by the control arrangement 4 (not shown). When the right edge of the portio A45' in FIG. 3 is reached, the heating wire designated n+4 is connected to the heating-voltage source again, and the stream of electrons to the anode is cut off. The heating wire designated n+6 is then grounded. Thus, electrons from this heating wire whose paths are located within the area bounded by the Line L6 are attracted to the anode and the conterelectrode. As a result, the area receiving electrons on the anode 5 in FIG. 3 is shifted to the right; it is designated A56. From the central portion A56' of the area A56, the control arrangement now selects electrons for the respective lines to be reproduced. In this manner, the current drain from the area cathode is shifted cyclically until the last heating wires associated with the corresponding picture edge are reached. After that, the same cycle starts again at the first heating wires.

FIG. 4 shows a circuit arrangement for performing the sequence of operations described above. It only shows the seven heating wires designated n to n+6, while the anode and the counterelectrode have been omitted for the sake of clarity. The left-hand end of each of the heating wires in FIG. 4 is connected via a switch $S_{Hn}$ to $S_{Hn+6}$ to the positive terminal of the heating-voltage source $U_H$, which delivers a voltage of, e.g., 15 V. The negative terminal of the heating-voltage source $U_H$ is connected to the positive terminal of the voltage source U, whose negative terminal is grounded. The voltage source U delivers a voltage of, e.g., 5 V. The right-hand end of each of the heating wires is connected to a changeover switch $S_{An}$ to $S_{An+6}$, which, in one position, makes a connection to the negative terminal of the heating-voltage source $U_H$ and to the positive terminal of the voltage source U, and, in its other position, connects the wire to ground.

In order to achieve the conditions shown in FIG. 3, the switches $S_{Hn}$ to $S_{Hn+3}$ and $S_{Hn+6}$ are closed and the changeover switches $S_{An}$ to $S_{An+3}$ and $S_{An+6}$ are in the positions in which they make a connection to the heating-voltage source $U_H$. Thus, the heating wires designated n to n+3 and n+6 are energized and heated. The switches $S_{Hn+4}$ and $S_{Hn+5}$ are open and the changeover switches $S_{An4}$ and $S_{An+5}$ are in the position in which they connect the heating wires designated n+4 and n+5 to ground. Thus, electrons are attracted to the anode and the counterelectrode from the heating wires designated n+4 and n+5. To shift the electron emission, the switch $S_{Hn+4}$ is closed, the switch $S_{Hn+6}$ is opened and the changeover switches $S_{An+4}$ and $S_{An+6}$ are placed in their other positions.

To achieve brightness modulation of the individual picture elements in the respective line, a voltage between 5 V and minus 20 V is applied to the corrsponding segments of the counterelectrode 6. Since such brightness control of the picture elements has a direct effect on the emission of the heating wires, dynamic operation of the emission of the heating wires is obtained as shown in FIG. 2A. Unlike static operation with constant maximum emission as is known from the prior art, this is a state which is adapted to the oxide-coated heating wires and in which these wires have a long life.

Figure 5:
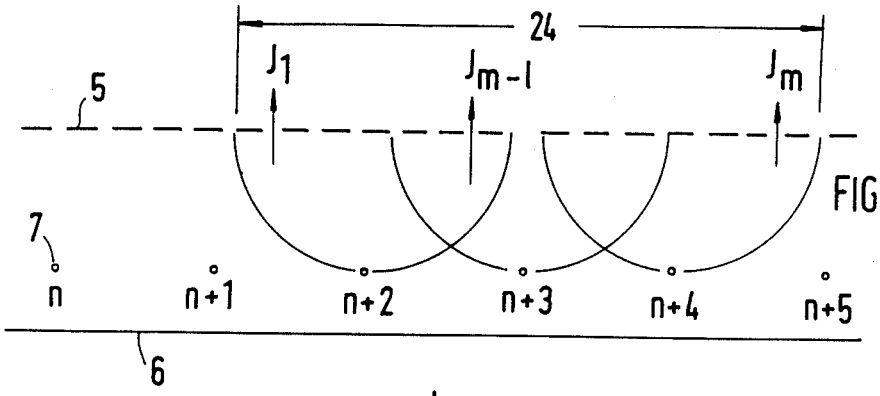
FIG. 5 is a schematic representation of part of the cathode to illustrate the current drain.

FIG. 5 is a schematic representation of part of the area cathode, the anode 5 and the counterelectrode 6. The heating wires 7 are designated n to n+5. It will be assumed that the heating wires designated n+2, n+3 and n+4 emit electrons towards the perforated anode 5 in an area 24. Associated with this area 24 are the lines 1 to m to be reproduced, by the phosphor coating 3 on faceplate 1. Each line has an associated electron current designated $J_1$ to $J_m$. In line 1, the resulting current is $J_1$, in line m−1 the current is $J_{m-1}$, and in line m, the current is $J_m$, where 1 is an integer.

Figure 6:
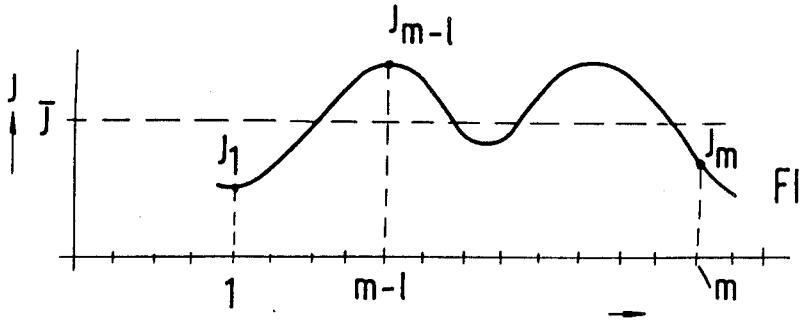
FIG. 6 is a graph showing the current drain for each line.

If the distance between the heating wires 7 and the anode 5 is in the range of a few millimeters, the current $J_{m-1}$ may be different from the current $J_1$ because line 1 has a different position from that of line m−1 with respect to the heating wires. As a result, the two lines differ in brightness. For this example, the line current to be measured is plotted in FIG. 6 as a function of the line position. The current value J represents the desired mean value of the current which should be reached in each line.

Figure 7:
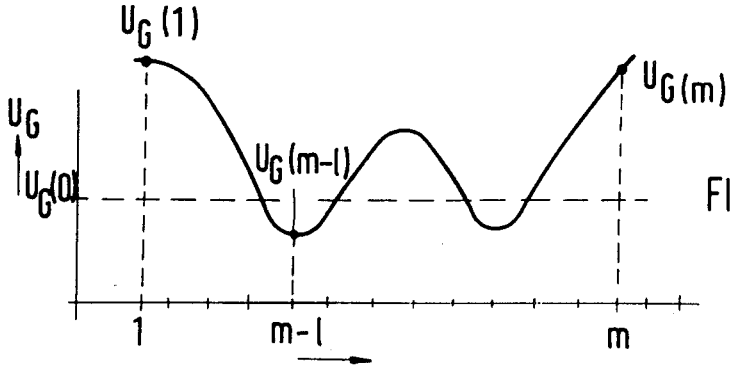
FIG. 7 is a graph of the voltages applied to the segments.

The different currents for the individual lines are obtained if a constant voltage $U_G(O)$ is applied to the counterelectrode 6. In FIG. 7, where the voltage $U_G$ is plotted versus the line position, this value is shown as a broken line. The differences in brightness between the individual lines can be compensated for by replacing the constant voltage $U_G(O)$, which is adjusted without correction, by a variable voltage $U_G$ which is adjusted from line to line. The corresponding voltage values $U_G(1)$, $U_G(m-1)$ and $U_G(m)$ for the lines 1, m−1 and m are shown in FIG. 7. With this voltage waveform, it is possible to set the current value $\bar{J}$, which is constant for all lines, from the undesireable current distribution shown in FIG. 6.

Figure 8:
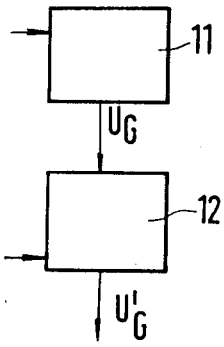
FIG. 8 is a block diagram showing the means for providing correcting voltages.

The correction described above can be achieved with the circuit of FIG. 8 by proceeding as follows.

In the picture-reproducing device to be corrected, a white picture is written line by line. For the preset average current $\bar{J}$ within each line, the corresponding voltage $U_G$ at the counterelectrode is determined and stored in a storage 11. During operation, the voltage value corresponding to each line is read out of this storage 11. For each line, the voltage value $U_G$ is selected from the storage 11 at the horizontal repetition rate, and it is combined with the video signal in a mixer 12 to produce a control signal $U_G'$. In the simplest case, an addition is performed in the mixer 12. However, even further corrections can be made by this method. For example, the storage may not only contain values for the different lines but may also take into account the dependence on the position of the picture element. Thus, a specific setting is possible for each picture element and its current dependence. This task may be performed by a microprocesor.

What is claimed is:

1. A flat, vacuum-enclosed device for reproducing a picture by displaying a plurality of parallel lines each comprising a plurality of picture elements, said lines and elements each having a desired brightness, said device comprising:

a phosphor-coated glas faceplate for displaying said lines and elements;

a shallow tray-shaped rear housing attached to the faceplate forming an evacuated enclosure;

a cathode consisting of a periodic array of oxide-coated heating wires arranged parallel to the lines to be displayed on the faceplate and disposed in said enclosure in a plane parallel to the faceplate;

a counterelectrode disposed between said cathode and the rear housing, said counterelectrode comprising individual electrically isolated segments arranged perpendicular to the oxide-coated heating wires of the cathode;

a control arrangement disposed between the cathode and the faceplate;

a perforated anode mounted between the cathode and the control arrangement;

means for applying an electrical potential to the anode;

means for applying selected electrical potentials to the segments of the counterelectrode;

means for selectively applying a first or a second electrical potential to selected ones of said oxide-coated heating wires, so that one of said first and second electrical potentials functions to heat the wires to which it is applied and the other electrical potential allows the wires to emit electrons which are attracted towards the anode to a degree depending upon the electrical potential applied to an adjacent segment of the counterelectrode;

means for applying electrical potentials to the segments of the counterelectrode to provide brightness modulation; and means for applying electrical correction potentials to the segments of the counterelectrode on a line-by-line basis for balancing the brightness of adjacent lines displayed on the faceplate.

2. A flat picture-reproducing device as claimed in claim 1, wherein the distance between the anode and the heating wires is one to ten times the distance between the counterelectrode and the heating wires.

3. A flat picture-reproducing device as claimed in claim 1, additionally comprising means for storing the required electrocal correction potential for each line and means for applying the appropriate electrical correction potential to the counterelectrode for a line being displayed.

4. A flat picture-reproducing device as claimed in claim 3, wherein the means for storing stores a electrical correction potential for each picture element to be displayed on the faceplate.

5. A flat picture-reproducing device as claimed in claim 4, additionally comprising means for mixing the electrical correction potential for each picture element with a brightness modulation signal received by said device.

6. A flat picture-reproducing device as claimed in claim 1, wherein one end of each heating wire is connected via a switch to the positive terminal of a heating-voltage source, and that the other end of each heating wire is connected via a changeover switch to the negative terminal of the heating-voltage source or to ground, with the negative terminal of the heating-voltage source connected to the positive terminal of a voltage source having its other terminal grounded.

7. A method for operating the flat picture-reproducing device claimed in claim 1, including the steps of:

applying a positive voltage of 10 to 20 V to the anode;

applying different negative and positive voltages averaging about 5 V to the segments of the counterelectrode; and withdrawing a stream of electrons only from two associated heating wires to form a line to be displayed on the faceplate.

8. A method as claimed in claim 7, wherein the heating wires are at positive potential with respect to the counterelectrode while being heated, and at zero potential during the withdrawal of the stream of electrons.

9. A method as claimed in claim 8, wherein the stream of electrons is withdrawn from pairs of neighboring heating wires.

10. A method as claimed in claim 7, wherein depending on the brightness of the respective picture element in the line being displayed, a voltage of −15 to 5 V is applied to the segments of the counterelectrode.

11. A method as claimed in claim 10, additionally comprising the step of subjecting the segments of the counterelectrode to correcting voltages to correct undesired brightness differences between the individual lines.

12. A method as claimed in claim 11, wherein the correcting voltages applied to the segments are −5 to 10 V.

13. A method as claimed in claim 11, wherein the values of the correcting voltages are taken from a storage means and are applied together with video signals.

14. A method as claimed in claim 13, wherein the correction is effected line by line and picture element by picture element.

15. A flat picture-reproducing device, as claimed in claim 1, wherein said control arrangement consists of two layers of electrodes.

* * * * *